US012485318B2

(12) United States Patent
Madson et al.

(10) Patent No.: US 12,485,318 B2
(45) Date of Patent: Dec. 2, 2025

(54) GOLF BALL INCLUDING PROTRUSIONS ON INTERMEDIATE LAYER

(71) Applicant: Acushnet Company, Fairhaven, MA (US)

(72) Inventors: Michael R. Madson, Easton, MA (US); Courtney N. Engle, Fall River, MA (US); Michael Michalewich, Norton, MA (US)

(73) Assignee: Acushnet Company, Fairhaven, MA (US)

( * ) Notice: Subject to any disclaimer, the term of this patent is extended or adjusted under 35 U.S.C. 154(b) by 102 days.

(21) Appl. No.: 18/330,398

(22) Filed: Jun. 7, 2023

(65) Prior Publication Data

US 2024/0408454 A1 Dec. 12, 2024

(51) Int. Cl.
*A63B 37/06* (2006.01)
*A63B 37/00* (2006.01)

(52) U.S. Cl.
CPC ..... *A63B 37/004* (2013.01); *A63B 37/0075* (2013.01)

(58) Field of Classification Search
CPC ..... A63B 37/0097; A63B 37/0004
See application file for complete search history.

(56) References Cited

U.S. PATENT DOCUMENTS 6,213,893 B1 4/2001 Maruko et al.
6,217,463 B1 4/2001 Maruko et al.
6,267,695 B1 * 7/2001 Masutani ..... A63B 37/0004 473/378
6,293,877 B1 * 9/2001 Boehm ..... A63B 37/0097 473/378
6,296,578 B1 10/2001 Masutani
6,379,270 B2 4/2002 Maruko et al.
6,383,091 B1 5/2002 Maruko et al.
6,383,092 B1 * 5/2002 Ogg ..... A63B 37/0004 473/378
6,406,385 B1 6/2002 Masutani et al.
6,416,423 B1 * 7/2002 Masutani ..... B29C 45/14065 473/367
6,508,726 B1 1/2003 Yamagishi et al.
6,575,847 B1 6/2003 Yamagishi et al.
6,595,874 B2 7/2003 Sullivan et al.
6,605,243 B1 8/2003 Masutani
6,685,580 B2 2/2004 Sullivan
6,743,123 B2 6/2004 Sullivan
6,756,436 B2 6/2004 Rajagopalan et al.
6,773,364 B2 8/2004 Sullivan et al.
6,786,838 B2 9/2004 Sullivan et al.
7,022,034 B2 * 4/2006 Sullivan ..... A63B 37/02 473/374
7,377,863 B2 5/2008 Sullivan et al.
7,378,483 B2 5/2008 Wu et al.
(Continued)

*Primary Examiner* — Raeann Gorden
(74) *Attorney, Agent, or Firm* — Thomas P. Gushue

(57) ABSTRACT

A golf ball is disclosed herein that includes an intermediate layer having protrusions. Among other advantages, the geometry and profile of the protrusions are optimized to provide increased stiffness on shots with higher club head speeds, while maintaining the volume of the softer cover material in order to maintain sufficient spin on wedge shots. The protrusions are further configured to transfer energy during high speed club impacts and more efficiently reduce long game spin.

19 Claims, 11 Drawing Sheets

(56) References Cited

U.S. PATENT DOCUMENTS

| | | | | |
|---|---|---|---|---|
| 7,410,429 | B1 | 8/2008 | Bulpett et al. | |
| 8,029,388 | B2 | 10/2011 | Nardacci et al. | |
| 8,568,250 | B2 | 10/2013 | Chou et al. | |
| 8,979,675 | B2 | 3/2015 | Bender et al. | |
| 8,986,136 | B2 | 3/2015 | Alan | |
| 9,095,749 | B2 | 8/2015 | Bulpett et al. | |
| 9,211,442 | B2 | 12/2015 | Felker et al. | |
| 9,283,440 | B2 | 3/2016 | Ishii et al. | |
| 9,289,656 | B2 * | 3/2016 | Ishii | A63B 37/005 |
| 9,440,115 | B2 | 9/2016 | Madson et al. | |
| 9,457,237 | B2 | 10/2016 | Alan | |
| 9,457,238 | B2 | 10/2016 | Alan | |
| 9,468,810 | B2 | 10/2016 | Madson et al. | |
| 9,468,814 | B2 | 10/2016 | Ishii et al. | |
| 9,492,716 | B2 | 11/2016 | Ishii et al. | |
| 9,573,023 | B2 | 2/2017 | Ishii et al. | |
| 9,586,096 | B2 | 3/2017 | Ishii et al. | |
| 9,630,061 | B2 | 4/2017 | Sullivan et al. | |
| 9,636,549 | B2 | 5/2017 | Bulpett et al. | |
| 9,737,766 | B2 | 8/2017 | Sullivan et al. | |
| 9,844,702 | B2 | 12/2017 | Ishii et al. | |
| 9,939,291 | B2 | 4/2018 | Sullivan et al. | |
| 9,968,831 | B2 | 5/2018 | Sullivan et al. | |
| 10,010,764 | B2 | 7/2018 | Sullivan et al. | |
| 10,076,684 | B2 | 9/2018 | Sullivan et al. | |
| 10,486,028 | B2 | 11/2019 | Nardacci et al. | |
| 10,668,334 | B2 | 6/2020 | Madson et al. | |
| 10,695,617 | B1 | 6/2020 | Madson | |
| 11,376,474 | B2 | 7/2022 | Engle et al. | |
| 2002/0016225 | A1 * | 2/2002 | Maruko | A63B 37/0097 473/371 |
| 2005/0256274 | A1 * | 11/2005 | Voorheis | C08K 5/0033 473/371 |

* cited by examiner

GOLF BALL INCLUDING PROTRUSIONS ON INTERMEDIATE LAYER

FIELD OF THE INVENTION

The present disclosure generally relates to a specific golf ball construction, and more particularly relates to protrusion features for a component of a golf ball.

BACKGROUND OF THE INVENTION

Various golf ball constructions are well known, such as golf balls including a core, a cover, and an intermediate layer arranged therebetween. Adjusting the thickness of particular layers, such as the cover, can affect the speed and spin profiles of the golf ball. There is consumer demand for golf balls that are engineered to balance the speed and spin profiles for the entire spectrum of golf clubs, i.e., drivers, fairway woods, hybrids, irons, wedges, etc.

It would be desirable to provide a golf ball that provides improved stiffness on shots using higher club speeds while maintaining a desirable spin profile for lower speed or wedge shots.

SUMMARY OF THE INVENTION

Various features are disclosed herein that are directed to golf ball design and construction in which the volume of the cover is maintained, while also increasing stiffness for shots with higher club speeds and maintaining a relatively high spin for wedge or lower speed shots.

According to one aspect, the present disclosure is directed to disposing protrusions on an intermediate layer of a golf ball to more efficiently transfer energy during high-speed club impacts in order to reduce long game spin.

In some aspects, the golf ball described herein includes a core, an intermediate layer disposed around the core, and a cover surrounding the intermediate layer. The intermediate layer can include: a base portion defining a radially inner surface and a radially outer surface, and a plurality of protrusions extending from the base portion. The protrusions can each include: a sidewall surface, and a top surface having a spherical profile with a radius of curvature that is concentric with the radially outer surface of the base portion. Stated differently, the radius of curvature of the base portion of the intermediate layer (i.e., landing surface or fret surface between the protrusions) and the radius of curvature of the top surfaces of the protrusions can be concentric.

In some aspects, the top surface of the protrusions can have a maximum protrusion radius ($R_{max}$) defined by an outermost radial distance of at least one outermost radial point among the protrusions. The maximum protrusion radius ($R_{max}$) can be at least 0.805 inches and no greater than 0.835 inches, in one example. In some aspects, the maximum protrusion radius ($R_{max}$) can be at least 0.815 inches and no greater than 0.835 inches.

In some aspects, the intermediate layer has a base volume ($V_b$) defined by:

$$V_b = \frac{4}{3}\pi\left(R_b^3 - R_i^3\right)$$

where $R_b$ is a base outer surface radius defined by the radially outer surface of the base portion, and $R_i$ is a base inner surface radius defined by the radially inner surface of the base portion.

In some aspects, the intermediate layer has a total volume ($V_L$) defined by:

$$V_L = V_b + V_p$$

where $V_p$ is a volume of the protrusions. One of ordinary skill in the art would understand that the volume of the protrusions ($V_p$) can be determined based on analytical measurement techniques, such as computer-aided design, or other known measurement techniques.

In some aspects, the techniques described herein relate to a golf ball, wherein the intermediate layer has a mean radius ($R_\mu$) defined by:

$$R_\mu = \sqrt[3]{\frac{3V_L}{4\pi} + R_i^3}$$

In one example, the mean radius ($R_\mu$) of the intermediate layer can be at least 0.800 inches and no greater than 0.835 inches. In some examples, the mean radius ($R_\mu$) of the intermediate layer can be at least 0.810 inches and no greater than 0.825 inches.

In some aspects, the quantity of protrusions can be at least 20 and no greater than 500. In other aspects, the quantity of protrusions can be at least 200 and no greater than 300.

In some aspects, the cover defines a plurality of dimples, and a quantity of the dimples is greater than a quantity of the protrusions. In other aspects, the quantity of dimples is less than the quantity of protrusions.

In some aspects, the cover defines a plurality of dimples, and a difference can be defined between a quantity of the dimples and a quantity of the protrusions. For example, the difference between the quantities of the dimples and protrusions can be less than 100. In other examples, the difference between the quantities of the dimples and protrusions can be at least 100 and no greater than 200. The difference between the quantities of the dimples and protrusions can be greater than 200. In some aspects, the quantity of the dimples can be 100-200 less than the quantity of the protrusions. In some aspects, the quantity of the dimples can be 100-200 greater than the quantity of the protrusions. In some examples, the dimples outnumber the protrusions. In other examples, the protrusions outnumber the dimples. In yet another example, the quantities of protrusions and dimples are identical.

In some aspects, the intermediate layer can have a contact surface coverage ratio ($S_r$) defined by:

$$S_r = \frac{S_p}{4\pi R_{max}^2}$$

where $S_p$ is a surface area of all top surfaces of the protrusions (i.e., a cumulative surface area of the top surfaces of the protrusions). In some aspects, the contact surface coverage ratio ($S_r$) can be at least 0.05 and no greater than 0.50. In some aspects, the contact surface coverage ratio ($S_r$) can be at least 0.10 and no greater than 0.75.

In some aspects, a maximum protrusion height ($h_p$) is defined by:

$$h_p = R_{max} - R_b$$

where $R_b$ is a base outer surface radius defined by the radially outer surface of the base portion, and $R_{max}$ is a maximum protrusion radius defined by an outermost radial distance of at least one outermost radial point among the protrusions. In some aspects, the maximum protrusion height ($h_p$) is at least 0.003 inches and no greater than 0.020 inches.

In some aspects, the protrusions each have a circular plan profile. The circular plan profile can be defined at a base of the protrusions and/or a tip of the protrusions.

In one aspect, the sidewall surface of the protrusions has a profile that is straight or flat. In one aspect, the sidewall surface of the protrusions has a profile that is curved. In some aspects, the sidewall surface of the protrusions has a profile that is at least one of: (i) normal relative to the radially outer surface of the base portion, (ii) angled relative to the radially outer surface of the base portion, (iii) curved, (iv) concave, or (v) convex. The protrusions can have a stepped profile in some examples.

Additional aspects and features of the golf ball and its protrusions are disclosed herein.

BRIEF DESCRIPTION OF THE DRAWINGS

Further features and advantages of the invention can be ascertained from the following detailed description that is provided in connection with the drawings described below.

DETAILED DESCRIPTION OF THE INVENTION

Figure 1:
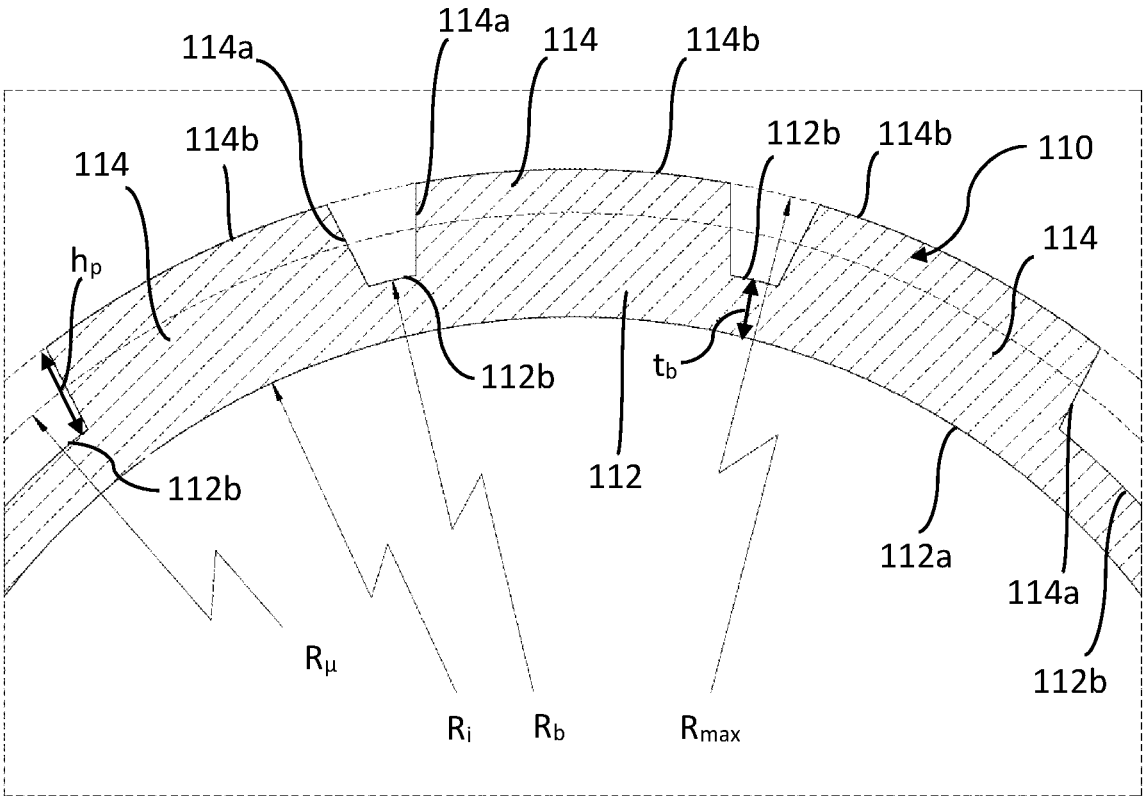
FIG. 1 is a cross-sectional view of a portion of an intermediate layer of a golf ball according to a first aspect.

In one aspect, a golf ball with a core, a cover, and at least one intermediate layer is disclosed herein. The intermediate layer comprises a base portion and a plurality of protrusions extending from the base portion. Based on the protrusions, the intermediate layer has a non-uniform thickness. The base portion can have a spherical profile, and the protrusions can include a spherical top surface that is concentric with an outer fret surface of the base portion (i.e., radially outer surface of the base portion). The top surfaces of the protrusions can also be concentric with a radially inner surface of the base portion. In another aspect, the top surfaces of the protrusions can also be concentric with a radially inner surface of the cover and/or an outer fret surface of the cover. One of ordinary skill in the art would understand that the top surfaces of the protrusions can further be concentric with a radial outer surface of the core. The top surfaces of the protrusions have a non-linear profile, in one aspect. The top surfaces of the protrusions are continuously curved, in another aspect. The protrusions can include at least two distinct surfaces, in one example. In other examples, the protrusions can include a single surface, or more than two surfaces.

The intermediate layer can form a mantle or a casing, in one aspect. The intermediate layer can encase the core, which can include a single core, dual core, or any other type of core construction. In one aspect, at least one additional intermediate layer can be included in the golf ball construction. The cover can consist of a single layer, dual layer, or multi-layer construction.

In some aspects, the golf ball described herein includes a core, an intermediate layer disposed around the core, and a cover surrounding the intermediate layer. The intermediate layer can include: a base portion defining a radially inner surface and a radially outer surface, and a plurality of protrusions extending from the base portion. The protrusions can each include two distinct surfaces, such as a sidewall surface, and a top surface. In one aspect, the sidewall surface and the top surface can be tangential with each other. In another aspect the sidewall surface and the top surface can be non-tangential with each other. The top surface can have a spherical profile with a radius of curvature that is concentric with a radius of curvature of the radially outer surface of the base portion. Exemplary characteristics of the core, cover, and intermediate layer are further described herein.

In one example, the core is formed from rubber, as is well known in the art. The core composition can include various additives. In one example, the cover is formed from polyurethane, polyurea, or hybrid of polyurethane-polyurea, as is well known in the art. Various compositions and constructions for cores and covers are disclosed in U.S. Pat. Nos. 9,636,549; 9,737,766; 9,968,831; and 10,076,684, which are each incorporated by reference in their entirety as if fully set forth herein.

Conventional and non-conventional materials may be used for forming intermediate layers of the ball including, for instance, ionomer resins, highly neutralized polymers, polybutadiene, butyl rubber, and other rubber-based core formulations, and the like. In one embodiment, the intermediate layer includes an ionomer. In this aspect, ionomers suitable for use in accordance with the present disclosure may include partially neutralized ionomers and highly neutralized ionomers (HNPs), including ionomers formed from blends of two or more partially-neutralized ionomers, blends of two or more highly-neutralized ionomers, and blends of one or more partially-neutralized ionomers with one or more highly-neutralized ionomers. For purposes of the present disclosure, "HNP" refers to an acid copolymer after at least 70 percent of all acid groups present in the composition are neutralized.

Exemplary ionomers are salts of O/X- and O/X/Y-type acid copolymers, wherein O is an α-olefin, X is a $C_3$-$C_8$ α,β-ethylenically unsaturated carboxylic acid, and Y is a softening monomer. O can be selected from ethylene and propylene. X can be selected from methacrylic acid, acrylic acid, ethacrylic acid, crotonic acid, and itaconic acid. Methacrylic acid and acrylic acid are particularly preferred. Y can be selected from (meth)acrylate and alkyl (meth)acrylates wherein the alkyl groups have from 1 to 8 carbon atoms, including, but not limited to, n-butyl (meth)acrylate, isobutyl (meth)acrylate, methyl (meth)acrylate, and ethyl (meth)acrylate.

Preferred O/X and O/X/Y-type copolymers include, without limitation, ethylene acid copolymers, such as ethylene/(meth)acrylic acid, ethylene/(meth)acrylic acid/maleic anhydride, ethylene/(meth)acrylic acid/maleic acid monoester, ethylene/maleic acid, ethylene/maleic acid mono-ester, ethylene/(meth)acrylic acid/n-butyl (meth)acrylate, ethylene/(meth)acrylic acid/isobutyl (meth)acrylate, ethylene/(meth)acrylic acid/methyl (meth)acrylate, ethylene/(meth)acrylic acid/ethyl (meth)acrylate terpolymers, and the like. The term, "copolymer," as used herein, includes polymers having two types of monomers, those having three types of monomers, and those having more than three types of monomers. Preferred α,β-ethylenically unsaturated mono- or dicarboxylic acids are (meth)acrylic acid, ethacrylic acid, maleic acid, crotonic acid, fumaric acid, itaconic acid. (Meth)acrylic acid is most preferred. As used herein, "(meth)acrylic acid" means methacrylic acid and/or acrylic acid. Likewise, "(meth)acrylate" means methacrylate and/or acrylate.

In a particularly preferred version, highly neutralized E/X- and E/X/Y-type acid copolymers, wherein E is ethylene, X is a $C_3$-$C_8$α,β-ethylenically unsaturated carboxylic acid, and Y is a softening monomer are used. X is preferably selected from methacrylic acid, acrylic acid, ethacrylic acid, crotonic acid, and itaconic acid. Methacrylic acid and acrylic acid are particularly preferred. Y is preferably an acrylate selected from alkyl acrylates and aryl acrylates and preferably selected from (meth)acrylate and alkyl (meth)acrylates wherein the alkyl groups have from 1 to 8 carbon atoms, including, but not limited to, n-butyl (meth)acrylate, isobutyl (meth)acrylate, methyl (meth)acrylate, and ethyl (meth)acrylate. Preferred E/X/Y-type copolymers are those wherein X is (meth)acrylic acid and/or Y is selected from (meth)acrylate, n-butyl (meth)acrylate, isobutyl (meth)acrylate, methyl (meth)acrylate, and ethyl (meth)acrylate. More preferred E/X/Y-type copolymers are ethylene/(meth)acrylic acid/n-butyl acrylate, ethylene/(meth)acrylic acid/methyl acrylate, and ethylene/(meth)acrylic acid/ethyl acrylate.

The amount of ethylene in the acid copolymer may be at least about 15 weight percent, at least about 25 weight percent, at least about 40 weight percent, or at least about 60 weight percent, based on total weight of the copolymer. The amount of $C_3$ to $C_8$ α,β-ethylenically unsaturated mono- or dicarboxylic acid in the acid copolymer is typically from 1 weight percent to 35 weight percent, from 5 weight percent to 30 weight percent, from 5 weight percent to 25 weight percent, or from 10 weight percent to 20 weight percent, based on total weight of the copolymer. The amount of optional softening comonomer in the acid copolymer may be from 0 weight percent to 50 weight percent, from 5 weight percent to 40 weight percent, from 10 weight percent to 35 weight percent, or from 20 weight percent to 30 weight percent, based on total weight of the copolymer.

The various O/X, E/X, O/X/Y, and E/X/Y-type copolymers are at least partially neutralized with a cation source, optionally in the presence of a high molecular weight organic acid, such as those disclosed in U.S. Pat. No. 6,756,436, the entire disclosure of which is hereby incorporated herein by reference. The acid copolymer can be reacted with the optional high molecular weight organic acid and the cation source simultaneously, or prior to the addition of the cation source. Suitable cation sources include, but are not limited to, metal ion sources, such as compounds of alkali metals, alkaline earth metals, transition metals, and rare earth elements; ammonium salts and monoamine salts; and combinations thereof. Preferred cation sources are compounds of magnesium, sodium, potassium, cesium, calcium, barium, manganese, copper, zinc, lead, tin, aluminum, nickel, chromium, lithium, and rare earth metals. The amount of cation used in the composition is readily determined based on desired level of neutralization. As disclosed above, for HNP compositions, the acid groups are neutralized to 70 percent or greater, 70 to 100 percent, or 90 to 100 percent. In one embodiment, an excess amount of neutralizing agent, that is, an amount greater than the stoichiometric amount needed to neutralize the acid groups, may be used. That is, the acid groups may be neutralized to 100 percent or greater, for example 110 percent or 120 percent or greater. In other embodiments, partially neutralized compositions are prepared, wherein 10 percent or greater, normally 30 percent or greater of the acid groups are neutralized. When aluminum is used as the cation source, it is preferably used at low levels with another cation such as zinc, sodium, or lithium, since aluminum has a dramatic effect on melt flow reduction and cannot be used alone at high levels. For example, aluminum is used to neutralize about 10 percent of the acid groups and sodium is added to neutralize an additional 90 percent of the acid groups.

One of ordinary skill in the art would understand that the intermediate layer, which can also be known as an outer core layer, inner cover layer, mantle, casing, etc., can be formed from any suitable materials as are known in the art. Suitable intermediate layer materials and compositions are known from existing commercial products, such as the 2021 and 2023. Titleist® Pro V1®, and the 2021 and 2023. Titleist® Pro V1x®.

In one aspect, the intermediate layer can be formed from at least two distinct materials. For example, the intermediate layer can include a base portion formed from a first material, and the protrusions can be formed from a second material that is different from the first material. In one aspect, the base portion can be formed from an ionomer, and the protrusions can be formed from a different material that does not include an ionomer. In one example, the second material can include at least one of thermoplastic polyurethane (TPU), styrene ethylene butylene styrene (SEBS), maleic anhydride (MAH) grafted polyolefin or polymer, or any other thermoplastic material. One of ordinary skill in the art would understand that an intermediate layer consisting of two distinct materials (i.e., a base portion and protrusions formed from different types of materials) can be formed via overmolding, co-injection molding, or other known formation or manufacturing techniques.

Returning to the specifics of the intermediate layer construction and its protrusions, in some aspects, the top surface of the protrusions can have a maximum protrusion radius ($R_{max}$) defined by an outermost radial distance of at least one outermost radial point among the protrusions, and the maximum protrusion radius ($R_{max}$) can be at least 0.805 inches and no greater than 0.835 inches. In some aspects, the maximum protrusion radius ($R_{max}$) is at least 0.815 inches and no greater than 0.835 inches. One of ordinary skill in the art would understand that the maximum protrusion radius ($R_{max}$) can vary depending on the specific design requirements for the golf ball.

In some aspects, the intermediate layer has a base volume ($V_b$) defined by:

$$V_b = \frac{4}{3}\pi\left(R_b^3 - R_i^3\right)$$

The base volume ($V_b$) can vary depending on the specific design requirements for the golf ball.

A thickness ($t_b$) of the base portion can be defined as a difference between the base outer surface radius ($R_b$) and the base inner surface radius ($R_i$). In one aspect, the thickness ($t_b$) of the base portion can be at least 0.010 inches and no greater than 0.050 inches. In another aspect, the thickness ($t_b$) of the base portion can be at least 0.020 inches and no greater than 0.100 inches. One of ordinary skill in the art would understand that the thickness ($t_b$) of the base portion can vary depending on the specific design requirements for the golf ball.

In some aspects, the intermediate layer has a volume ($V_L$) defined by:

$$V_L = V_b + V_p$$

where $V_p$ is a volume of the protrusions. One of ordinary skill in the art would understand that the volume of the protrusions ($V_p$) can vary depending on the specific design requirements for the golf ball. One of ordinary skill in the art would understand that the volume of the protrusions ($V_p$) can be determined based on analytical measurement techniques, such as computer-aided design, or known measurement techniques.

In one aspect, a ratio of the volume of the protrusions ($V_p$) to the volume of the base portion ($V_b$) can be 0.10-0.90. In a specific aspect, the ratio of the volume of the protrusions ($V_p$) to the volume of the base portion ($V_b$) can be 0.20-0.80. In another aspect, the ratio of the volume of the protrusions ($V_p$) to the volume of the base portion ($V_b$) can be 0.15-0.45. In one aspect, the ratio of the volume of the protrusions ($V_p$) to the volume of the base portion ($V_b$) can be at least 0.20. In one aspect, the ratio of the volume of the protrusions ($V_p$) to the volume of the base portion ($V_b$) can be no greater than 0.45. The ratio of the volume of the protrusions ($V_p$) to the volume of the base portion ($V_b$) can be expressed as $V_p$:$V_b$ herein. One of ordinary skill in the art would understand that the ratio of the volume of the protrusions to the volume of the base portion ($V_p$:$V_b$) can vary depending on the specific design requirements for the golf ball.

In some aspects, the intermediate layer has a mean radius ($R_\mu$) defined by:

$$R_\mu = \sqrt[3]{\frac{3V_L}{4\pi} + R_i^3}$$

In one example, the mean radius ($R_\mu$) of the intermediate layer is at least 0.800 inches and no greater than 0.835 inches. In some examples, the mean radius ($R_\mu$) of the intermediate layer is at least 0.810 inches and no greater than 0.825 inches. One of ordinary skill in the art would understand that the mean radius ($R_\mu$) of the intermediate layer can vary depending on the specific design requirements for the golf ball. The terms "mean radius ($R_\mu$)" and "mean radius ($R_\mu$) of the intermediate layer" can be used interchangeably herein.

In one aspect, a relationship between the mean radius ($R_\mu$) of the intermediate layer and the ratio of the volume of the protrusions to the volume of the base portion ($V_p$:$V_b$) can be defined by:

$$0.20 \le \frac{V_p : V_b}{R_\mu} \le 0.60$$

In one example, a relationship between the mean radius ($R_\mu$) of the intermediate layer and the ratio of the volume of the protrusions to the volume of the base portion ($V_p$:$V_b$) can be defined by:

$$0.40 \le \frac{V_p : V_b}{R_\mu} \le 0.60$$

In one example, a relationship between the mean radius ($R_\mu$) of the intermediate layer and the ratio of the volume of the protrusions to the volume of the base portion ($V_p$:$V_b$) can be defined by:

$$0.20 \le \frac{V_p : V_b}{R_\mu} \le 0.30$$

One of ordinary skill in the art would understand that the relationship between the mean radius ($R_\mu$) of the intermediate layer and the ratio of the volume of the protrusions to the volume of the base portion ($V_p$:$V_b$) can vary depending on the specific design requirements for the golf ball.

In one aspect, the volume of the protrusions ($V_p$) and a flexural modulus (FM) of the intermediate layer material can have a predefined relationship. In one example, a higher flexural modulus (FM) of the intermediate layer material can allow for a lower volume of the protrusions ($V_p$). In another example, a lower flexural modulus (FM) of the intermediate layer material can allow for a higher volume of the protrusions ($V_p$). In one aspect, the flexural modulus (FM) of the intermediate layer material can be 100 MPa-1,500 MPa. In another aspect, the flexural modulus (FM) of the intermediate layer material can be 200 MPa-1,000 MPa. One of ordinary skill in the art would understand that the flexural modulus (FM) of the intermediate layer material can vary.

In one aspect, the following predefined relationship can be provided between the volume of the protrusions ($V_p$) (in cubic inches) and the flexural modulus (FM) (in MPa) of the intermediate layer material: $5.0 \le FM \times V_p \le 100.0$. In another aspect, the predefined relationship between the volume of the protrusions ($V_p$) (in cubic inches) and the flexural modulus (FM) (in MPa) of the intermediate layer material can be: $1.0 \le FM \times V_p \le 200.0$. In another aspect, the predefined relationship between the volume of the protrusions ($V_p$) (in cubic inches) and the flexural modulus (FM) (in MPa) of the intermediate layer material can be: $15.0 \le FM \times V_p \le 55.0$. One of ordinary skill in the art would understand that the predefined relationship between the volume of the protrusions and flexural modulus of the intermediate layer material can vary depending on the desired performance characteristics of a particular golf ball design.

The quantity of the protrusions can be at least 20 and no greater than 500. The quantity of the protrusions can be at least 200 and no greater than 300. In some configurations, the cover defines a plurality of dimples, and a quantity of the dimples is greater than a quantity of the protrusions. In other aspects, the quantity of the dimples is less than the quantity of the protrusions.

In some aspects, a difference can generally be defined between a quantity of the dimples and a quantity of the protrusions. For example, the difference between the quantity of the dimples and the quantity of the protrusions can be less than 100. In other examples, the difference between the quantity of the dimples and the quantity of the protrusions can be at least 100 and no greater than 200. For example, if there are 350 dimples, then the quantity of protrusions can be between 150-250. The difference between the quantity of the dimples and the quantity of the protrusions can be greater than 200. For example, if there are 350 dimples, then the quantity of protrusions can be less than 150 or greater than 550. In some aspects, the quantity of the dimples can be 100-200 less than the quantity of the protrusions. In some aspects, the quantity of the dimples can be 100-200 greater than the quantity of the protrusions.

In one aspect, a ratio between the quantity of the protrusions and the quantity of the dimples can be 0.50-1.0. In another aspect, the ratio between the quantity of the protrusions and the quantity of the dimples can be 0.60-0.80. In yet another aspect, the ratio between the quantity of the protrusions and the quantity of the dimples can be 0.65-0.75.

In some aspects, the intermediate layer can have a contact surface coverage ratio ($S_r$) defined by:

$$S_r = \frac{S_p}{4\pi R_{max}^2}$$

where $S_p$ is a surface area of all top surfaces of the protrusions (i.e., a cumulative surface area of the top surfaces of the protrusions). In some aspects, the contact surface coverage ratio ($S_r$) is at least 0.05 and no greater than 0.70. In some aspects, the contact surface coverage ratio ($S_r$) is at least 0.15 and no greater than 0.50. In one aspect, a minimum value for the contact surface coverage ratio ($S_r$) can be at least 0.05, or at least 0.10, or at least 0.15, or at least 0.20, or at least 0.25, or at least 0.30, or at least 0.35. In one aspect, a minimum value for the contact surface coverage ratio ($S_r$) can be no greater than 0.05, or no greater than 0.10, or no greater than 0.15, or no greater than 0.20, or no greater than 0.25, or no greater than 0.30, or no greater than 0.35. One of ordinary skill in the art would appreciate based on this disclosure that a minimum value for the contact surface coverage ratio ($S_r$) can vary.

In one aspect, a maximum value for the contact surface coverage ratio ($S_r$) can be at least 0.40, or at least 0.45, or at least 0.50, or at least 0.55, or at least 0.60, or at least 0.65, or at least 0.70. In one aspect, a maximum value for the contact surface coverage ratio ($S_r$) can be no greater than 0.40, or no greater than 0.45, or no greater than 0.50, or no greater than 0.55, or no greater than 0.60, or no greater than 0.65, or no greater than 0.70. One of ordinary skill in the art would appreciate based on this disclosure that a maximum value for the contact surface coverage ratio ($S_r$) can vary.

In one aspect, the contact surface coverage ratio ($S_r$) is exactly one of the following values: 0.05, 0.10, 0.15, 0.20, 0.25, 0.30, 0.35, 0.40, 0.45, 0.50, 0.55, 0.60, 0.65, 0.70, 0.75, 0.80, 0.85, 0.90, or 0.95. In one aspect, the contact surface coverage ratio ($S_r$) is any value between 0.01 to 0.99.

One of ordinary skill in the art would understand that the contact surface coverage ratio ($S_r$) and the surface area of all top surfaces of the protrusions ($S_p$) can vary depending on the specific design requirements for the golf ball.

In one aspect, the contact surface coverage ratio ($S_r$) can depend upon the mean radius ($R_\mu$) of the intermediate layer, wherein:

$0.05 \le S_r \le 0.35$, when $R_\mu \ge 0.81$, and $0.35 \le S_r \le 0.70$, when $R_\mu < 0.81$ One of ordinary skill in the art would understand that the relationship between the contact surface coverage ratio ($S_r$) and the mean radius ($R_\mu$) of the intermediate layer can vary.

In some aspects, a maximum protrusion height ($h_p$) is defined by:

$$h_p = R_{max} - R_b$$

In some aspects, the maximum protrusion height ($h_p$) is at least 0.003 inches and no greater than 0.020 inches. In some aspects, the maximum protrusion height ($h_p$) is at least 0.010 inches and no greater than 0.040 inches. One of ordinary skill in the art would understand that the maximum protrusion height ($h_p$) can vary depending on the specific design requirements for the golf ball. In one aspect, the protrusions have a uniform or identical maximum protrusion height ($h_p$) along the entirety of the protrusions, such as shown in FIGS. 1-4. In another aspect, the protrusions can have a variable height, such as shown in FIG. 5.

In one aspect, a ratio of the maximum protrusion height ($h_p$) to the thickness ($t_b$) of the base portion can be defined by:

$$0.10 \le \frac{h_p}{t_b} \le 1.00$$

In one example, the ratio of the maximum protrusion height ($h_p$) to the thickness ($t_b$) of the base portion is 0.50-0.75. In yet another example, the ratio of the maximum protrusion height ($h_p$) to the thickness ($t_b$) of the base portion is 0.60-0.80. In yet another example, the ratio of the maximum protrusion height ($h_p$) to the thickness ($t_b$) of the base portion is 0.65-0.75.

In some aspects, the protrusions each have a circular plan profile. In some aspects, the sidewall surface of each of the protrusions has a profile that is at least one of: (i) normal relative to the radially outer surface of the base portion, (ii) angled relative to the radially outer surface of the base portion, (iii) curved, (iv) concave, or (v) convex. One of ordinary skill in the art would understand that the sidewall surface profile can vary depending on the specific design requirements for the golf ball.

The protrusions can be arranged on the intermediate layer using well known techniques, including dimple patterning techniques. For example, the protrusions can be arranged on the intermediate layer according to the profiles, patterns, techniques, etc., that are disclosed in U.S. Pat. Nos. 8,029,388; 9,440,115; 9,468,810; 10,486,028; and 11,376,474, which are each incorporated by reference in their entirety as if fully set forth herein. One of ordinary skill in the art would understand based on the present disclosure that any pattern or arrangement techniques can be used. In one aspect, the dimples on the cover and the protrusions on the intermediate layer can be disposed using identical patterns. In another aspect, the dimples on the cover and the protrusions on the intermediate layer can be arranged using different patterns.

The shapes of the protrusions can vary, as one of ordinary skill in the art would appreciate based on the present disclosure. In one example, the protrusions form a circular base plan shape, such that a shape of the points that mark the transition from the radially outer surface of the base portion to the sidewall surface of the protrusion forms a circle. The transition between the protrusion and the base portion can be defined as a point or region. In other configurations, the protrusions can have a non-circular base plan shape. For example, the protrusions can have elliptical, polygonal, convex polygonal, concave polygonal, and/or irregularly shaped plan shapes. In one aspect, the transition between the protrusion and the base portion can have a point of tangency. In another aspect, the transition between the protrusion and the base portion can lack any point of tangency.

In some examples, the protrusions are all identical. In other examples, the protrusions can have at least two different profiles. In yet other examples, the protrusions can have more than two different profiles. The protrusions can have different heights in one example. The protrusions can have different widths or thicknesses in one example. In other examples, the sidewalls of the protrusions can have different profiles. In yet another example, the top surfaces of the sidewalls of the protrusions can have different profiles.

In one aspect, the overall pattern of the protrusions is symmetrical. In another aspect, the overall profile of the overall pattern of the protrusions is asymmetrical.

With reference to the Figures, FIG. 1 illustrates an exemplary intermediate layer 110 for a golf ball. The intermediate layer 110 includes a plurality of protrusions 114 that extend from a base portion 112. The base portion 112 can define a radially inner surface 112*a* and a radially outer surface 112*b*. The radially inner surface 112*a* can be in direct contact with an outer surface of a core or core assemblage. The protrusions 114 can each comprise a sidewall surface 114*a*, and a top surface 114*b* having a spherical profile with a radius of curvature that is concentric with the radially outer surface 112*b* of the base portion 112. A maximum protrusion radius ($R_{max}$) is shown in FIG. 1 as being defined by an outermost radial distance of at least one outermost radial point among the protrusions 114. A base outer surface radius ($R_b$) is illustrated in FIG. 1 as being defined by the radially outer surface 112*b* of the base portion 112. The base outer surface radius ($R_b$) extends along a fret surface of the base portion 112 defined between the protrusions 114. A base inner surface radius ($R_i$) is illustrated in FIG. 1 as being defined by the radially inner surface 112*a* of the base portion 112. A mean radius ($R_\mu$) of the intermediate layer 110 is defined by:

$$R_\mu = \sqrt[3]{\frac{3V_L}{4\pi} + R_i^3}$$

where $V_L$ is volume of the intermediate layer, which is a sum of the volume of the protrusions ($V_p$) and the volume of the base portion ($V_b$). The protrusions 114 in FIG. 1 include sidewall surfaces 114*a* that have a cylindrical profile, and a spherical top surface 114*b* that is concentric with the radially outer surface 112*b* of the base portion 112. The top surfaces 114*b* can further be concentric with at least one of: the radially inner surface 112*a* of the base portion 112; a radially inner surface of a cover; a radially outer surface of a cover; a radially outer surface of a core or core assemblage; or a radially inner surface of a core layer.

Figure 2:
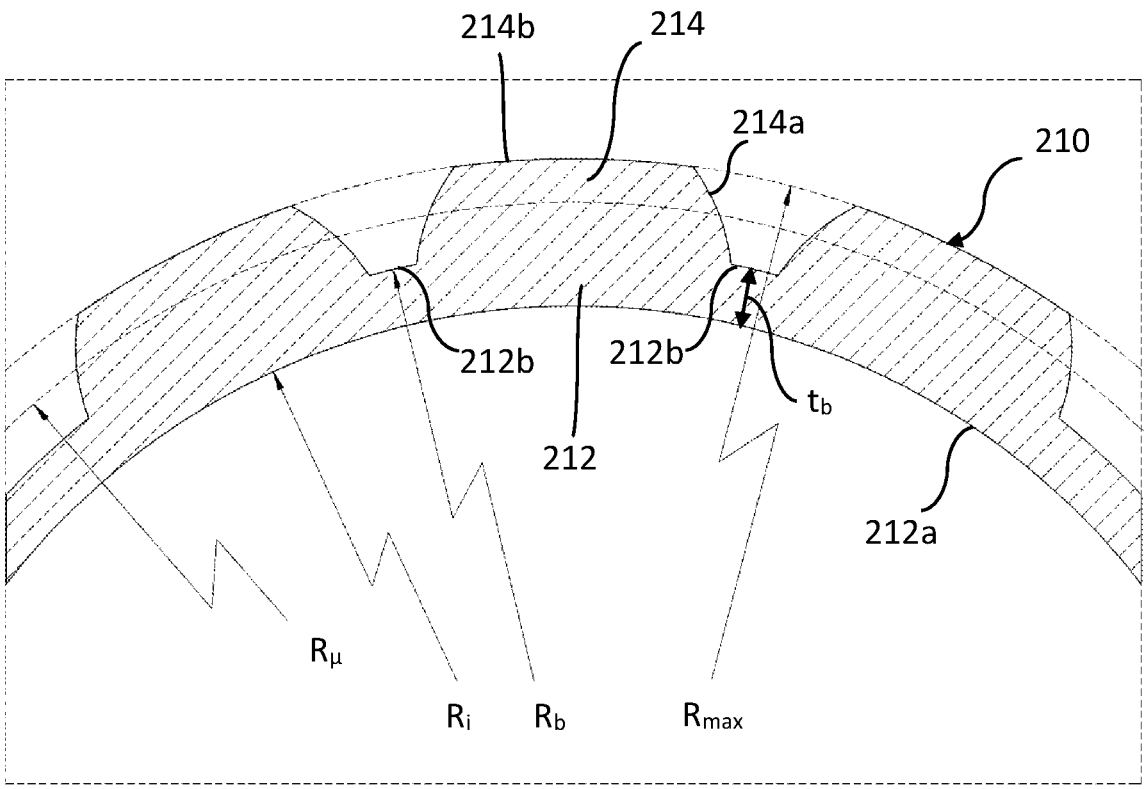
FIG. 2 is a cross-sectional view of a portion of an intermediate layer of a golf ball according to a second aspect.

FIG. 2 illustrates an exemplary intermediate layer 210 for a golf ball. The intermediate layer 210 includes protrusions 214 that extend from a base portion 212. The base portion 212 can define a radially inner surface 212*a* and a radially outer surface 212*b*. The protrusions 214 can each comprise a sidewall surface 214*a*, and a top surface 214*b* having a spherical profile with a radius of curvature that is concentric with a radius of curvature of the radially outer surface 212*b* of the base portion 212. The top surfaces 214*b* can further be concentric with at least one of: the radially inner surface 212*a* of the base portion 212; a radially inner surface of a cover; a radially outer surface of a cover; a radially outer surface of a core or core assemblage; or a radially inner surface of a core layer.

FIG. 2 further illustrates the maximum protrusion radius ($R_{max}$), the base outer surface radius ($R_b$), the base inner surface radius ($R_i$), and the mean radius ($R_\mu$) of the intermediate layer 210. The protrusions 214 in FIG. 2 have sidewall surfaces 214*a* that have a spherical profile. The concavity of the sidewall surfaces 214*a* and the concavity of the top surfaces 214*b* can be the same or matching. In other aspects, the concavities of the sidewall surfaces 214*a* and the top surfaces 214*b* can differ.

Figure 3:
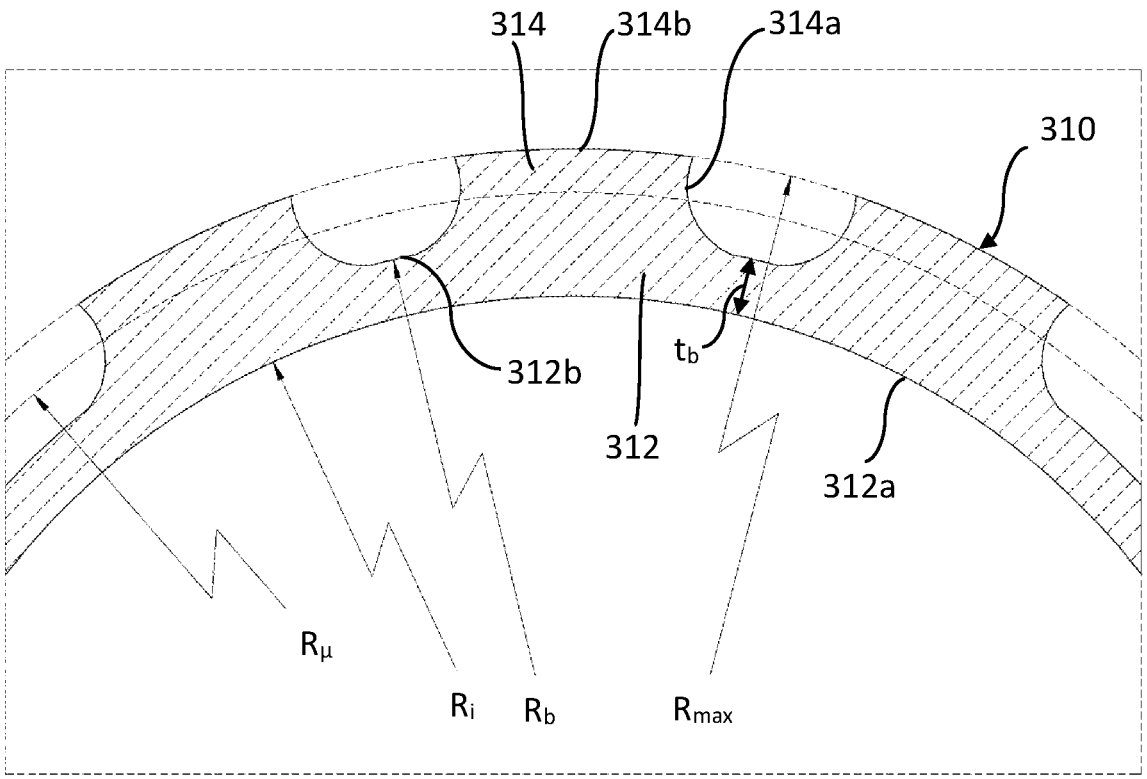
FIG. 3 is a cross-sectional view of a portion of an intermediate layer of a golf ball according to a third aspect.

FIG. 3 illustrates an exemplary intermediate layer 310 for a golf ball. The intermediate layer 310 includes protrusions 314 that extend from a base portion 312. The base portion 312 can define a radially inner surface 312*a* and a radially outer surface 312*b*. The protrusions 314 can each comprise a sidewall surface 314*a*, and a top surface 314*b* having a spherical profile with a radius of curvature that is concentric with the radially outer surface 312*b* of the base portion 312. The top surfaces 314*b* can further be concentric with at least one of: the radially inner surface 312*a* of the base portion 312; a radially inner surface of a cover; a radially outer surface of a cover; a radially outer surface of a core or core assemblage; or a radially inner surface of a core layer.

FIG. 3 further illustrates the maximum protrusion radius ($R_{max}$), base outer surface radius ($R_b$), base inner surface radius ($R_i$), and mean radius ($R_\mu$) of the intermediate layer 310. The protrusions 314 in FIG. 3 have sidewall surfaces 314*a* that have a spherical profile. The concavity of the sidewall surfaces 314*a* and the concavity of the top surfaces 314*b* can be different or opposite from each other.

Figure 4:
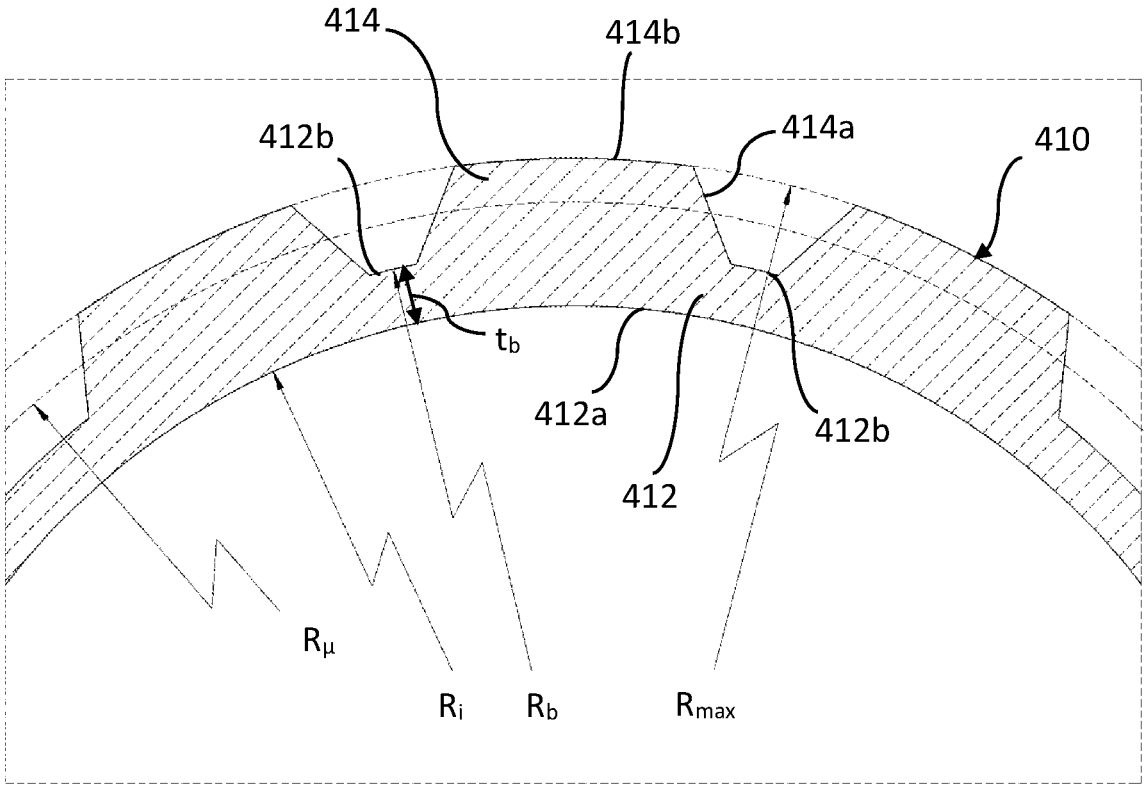
FIG. 4 is a cross-sectional view of a portion of an intermediate layer of a golf ball according to a fourth aspect.
Figure 5:
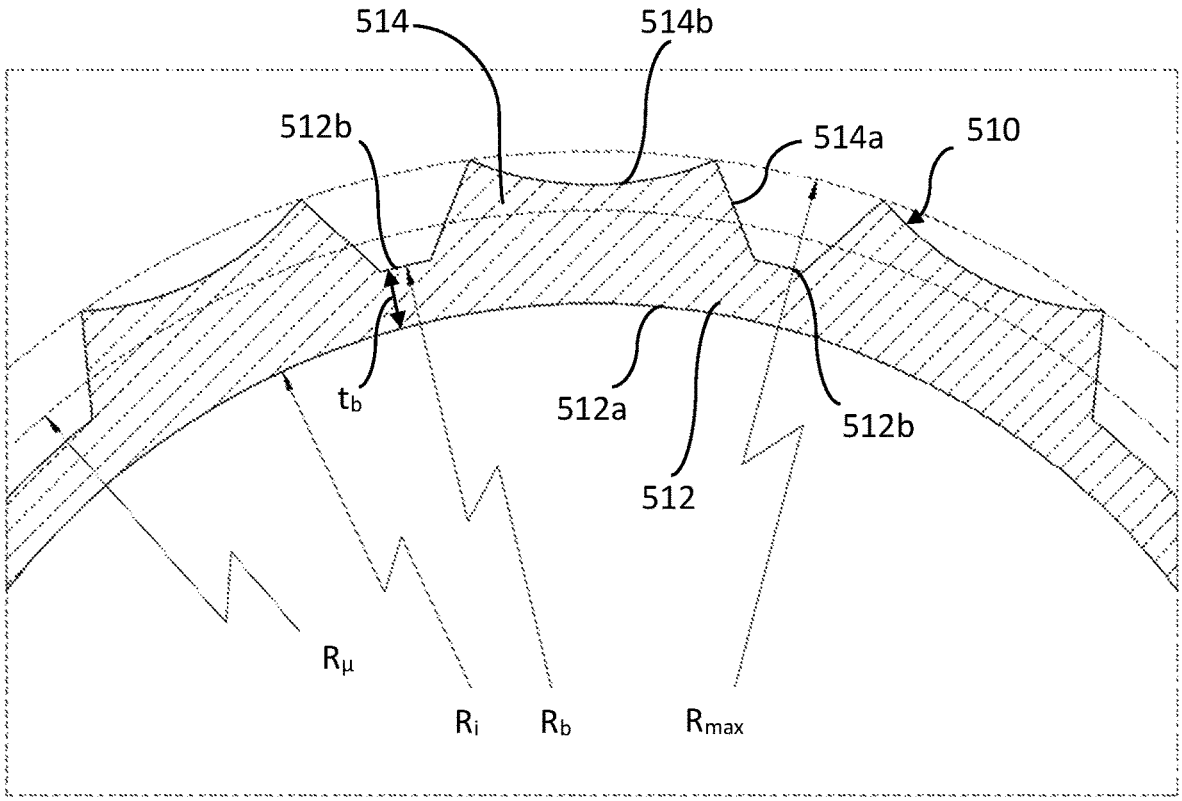
FIG. 5 is a cross-sectional view of a portion of an intermediate layer of a golf ball according to a fifth aspect.

FIG. 4 illustrates an exemplary intermediate layer 410 for a golf ball. The intermediate layer 410 includes protrusions 414 that extend from a base portion 412. The base portion 412 can define a radially inner surface 412*a* and a radially outer surface 412*b*. The protrusions 414 can each comprise a sidewall surface 414*a*, and a top surface 414*b* having a spherical profile with a radius of curvature that is concentric with the radially outer surface 412*b* of the base portion 412. FIG. 4 further illustrates the maximum protrusion radius ($R_{max}$), the base outer surface radius ($R_b$), the base inner surface radius ($R_i$), and the mean radius ($R_\mu$) of the intermediate layer 410. The protrusions 414 in FIG. 4 have sidewall surfaces 414*a* that have a conical profile. The top surfaces 414*b* can further be concentric with at least one of: the radially inner surface 412*a* of the base portion 412; a radially inner surface of a cover; a radially outer surface of a cover; a radially outer surface of a core or core assemblage; or a radially inner surface of a core layer.

FIG. 5 illustrates an exemplary intermediate layer 510 for a golf ball. The intermediate layer 510 includes protrusions 514 that extend from a base portion 512. The base portion 512 can define a radially inner surface 512*a* and a radially outer surface 512*b*. The protrusions 514 can each comprise a sidewall surface 514*a*, and a top surface 514*b* having a spherical profile with a radius of curvature that is concave in an opposite direction from the radially outer surface 512*b* of the base portion 512. The top surface 514*b* can be concave such that the top surfaces 514*b* bows radially inward relative to a radially outermost portion of the sidewall surface 514*a*. In one aspect, the top surface 514*b* has a spherical profile with a radius of curvature that is non-concentric with the radially outer surface 512*b* of the base portion 512. In this configuration, the height of the top surface 514*b* is lowest at a center of the protrusions 514. FIG. 5 further illustrates the maximum protrusion radius ($R_{max}$), the base outer surface radius ($R_b$), the base inner surface radius ($R_i$), and the mean radius ($R_\mu$) of the intermediate layer 510. The protrusions 514 in FIG. 5 have sidewall surfaces 514*a* that have a conical profile.

EXAMPLES

The follow descriptions are provided to further detail exemplary configurations for a golf ball including protrusions on the intermediate layer. These examples are in no way limiting to the various specific configurations that can be used in golf ball constructions including the protrusions described herein.

Example 1

In a first example, a three-piece golf ball is provided that includes a rubber core, a cast urethane cover, and an intermediate layer formed from a high flex ionomer. One of ordinary skill in the art would understand that other materials could be used to form any of these layers or components of the golf ball.

The core can have a diameter of 1.55 inches (+/−0.02 inches). The core can be formed primarily from a mixture of polybutadiene rubber and styrene butadiene rubber. Additives can be included in the rubber core composition. The rubber core composition can be crosslinked with a peroxide with the addition of zinc diacrylate as a coagent. Fillers and additives such as pigments, zinc oxide, and barium sulfate, zinc pentachlorothiophenol can also added to adjust gravity and affect final cured core properties, as one of ordinary skill in the art would understand. One of ordinary skill in the art would understand that the rubber core composition, the core size, and other characteristics of the core can vary depending on the specific design requirements for the golf ball.

The cover can be formed from a one shot method, prepolymer method, or other known method. In one aspect, the cover is formed from a hot cast polyurethane comprising the reaction product of an isocyanate functional prepolymer and an amine functional chain extender, as one of ordinary skill in the art would understand. Additionally, one of ordinary skill in the art would understand that the cover can be formed from other materials or can be formed from other formation techniques.

The intermediate layer can be formed from an ionomer or an ionomer blend. Specifically, the intermediate layer can be formed from a 50/50 blend of high acid sodium ionomer and high acid zinc ionomer. One of ordinary skill in the art would understand that this ratio can vary, and the specific ionomers can vary. In other aspects, compositions that do not include ionomers can be used to form the intermediate layer.

The protrusions on the intermediate layer can have a circular base plan shape. The top surface of the protrusions can be spherical and concentric with the radially outer surface of the base portion, and the sidewall surface can be spherical and have an opposing concavity to the top surface of the protrusions. There can be 250 protrusions extending radially outward as part of the intermediate layer. The protrusions can be arranged in an icosahedral pattern. The dimple pattern on the surface of the golf ball can have 348 dimples. In a more general configuration, there can be 225-275 protrusions, and there can be 325-375 dimples. One of ordinary skill in the art would understand that the quantities of dimples and protrusions can vary.

Table 1 is provided below to further detail specific characteristics of Example 1.

TABLE 1

| | |
|---|---|
| Number of Protrusions | 250 |
| $R_b$ | 0.805 in. |
| $R_{max}$ | 0.825 in. |
| $R_i$ | 0.775 in. |
| $t_b$ | 0.030 in. |
| $V_b$ | 0.235 in.$^3$ |
| $V_p$ | 0.049 in.$^3$ |
| $V_L$ | 0.284 in.$^3$ |
| $R_\mu$ | 0.811 in. |
| $h_p$ | 0.020 in. |
| $S_r$ | 0.16 |

Figure 6A:
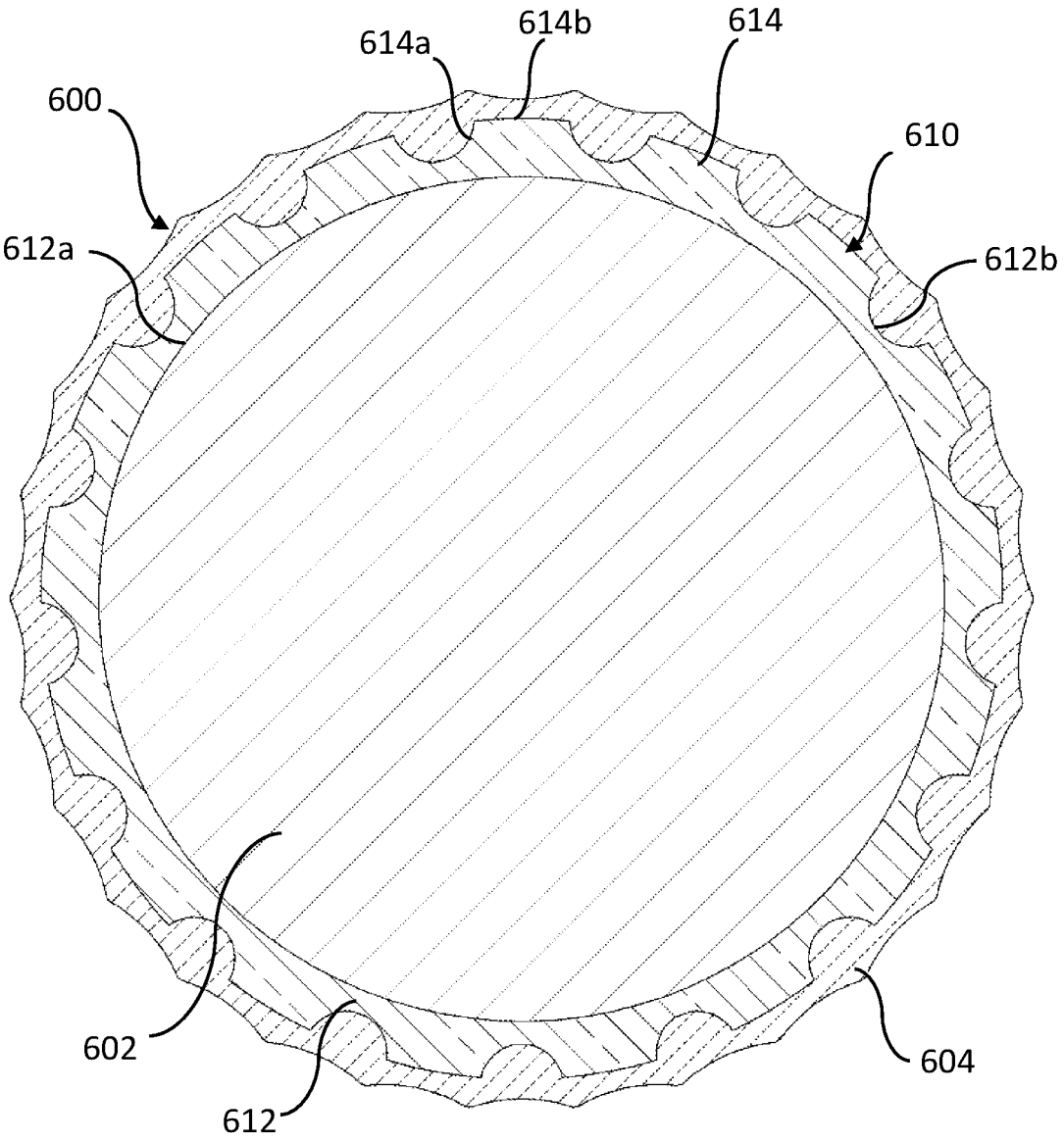
FIG. 6A is a cross-sectional view of a golf ball according to one example.
Figure 6B:
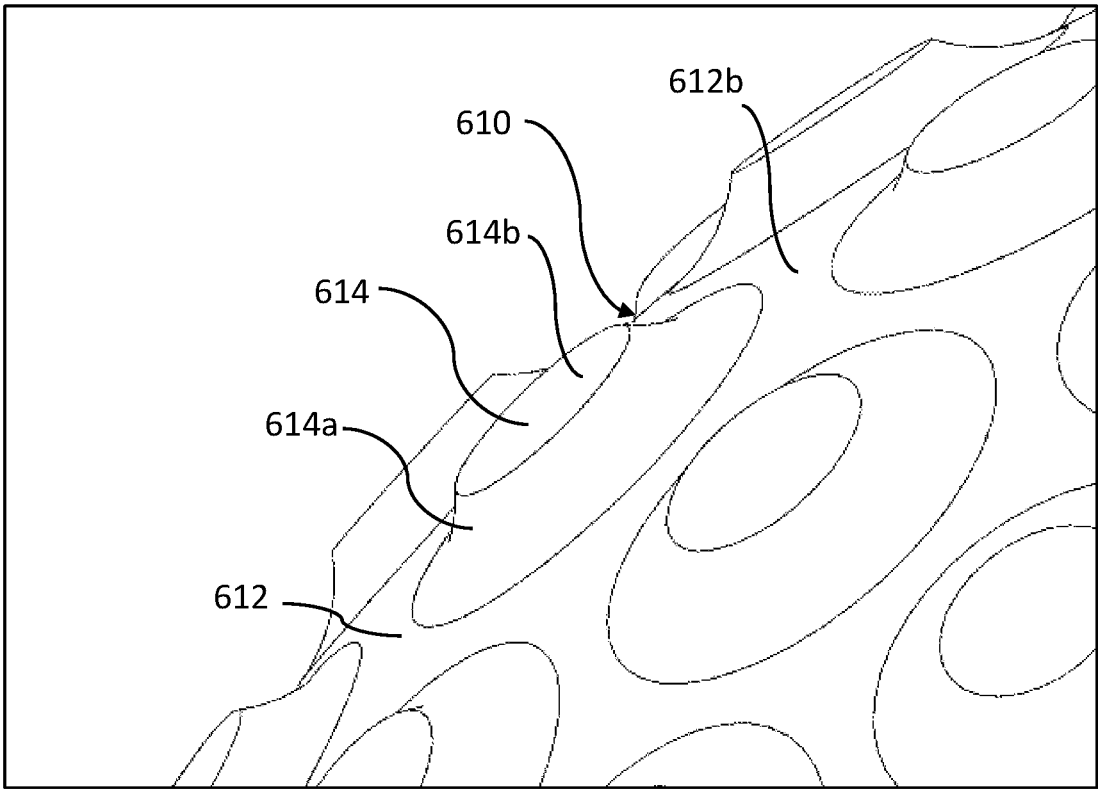
FIG. 6B is a magnified view of a portion of the intermediate layer of the golf ball of FIG. 6A.
Figure 6C:
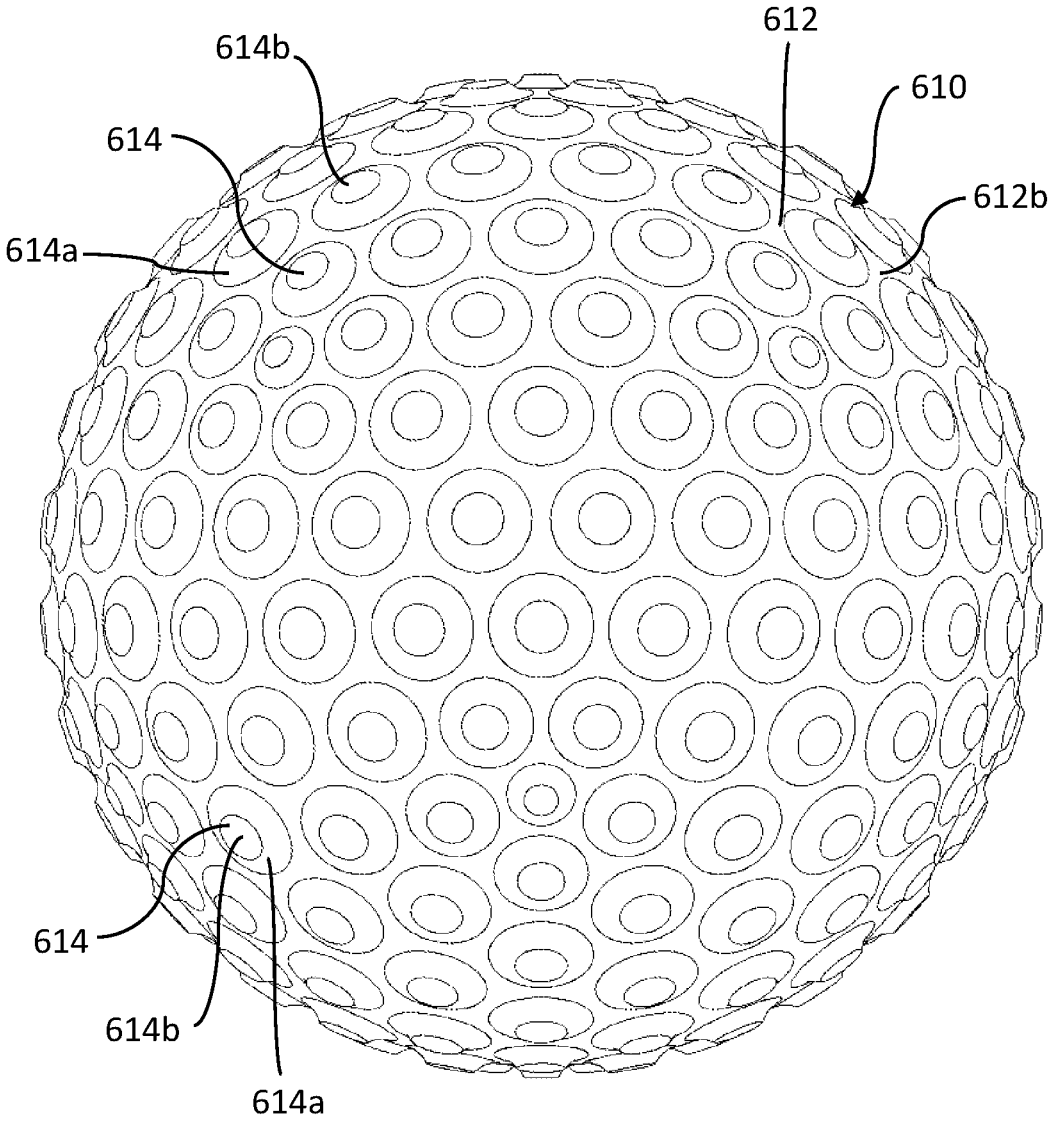
FIG. 6C is a perspective view of the intermediate layer of FIGS. 6A and 6B.

FIGS. 6A-6C illustrate the features for Example 1. FIG. 6A illustrates a golf ball 600 including an intermediate layer 610 with features as disclosed herein. The golf ball 600 further includes a core 602 and a cover 604. The intermediate layer 610 comprises protrusions 614 that extend radially outward from a base portion 612. As shown in FIG. 6A, spaces between the protrusions 614 are entirely filled with the cover 604. The base portion 612 can define a radially inner surface 612*a* and a radially outer surface 612*b*. The protrusions 614 can each comprise a sidewall surface 614*a* (which intersects with the radially outer surface 612*b* of the base portion 612), and a top surface 614*b* having a spherical profile with a radius of curvature that is concentric with the radially outer surface 612*b* of the base portion 612. The features of the intermediate layer 610 are illustrated in further detail in FIGS. 6B and 6C.

Example 2

In a second example, a three-piece golf ball is provided that includes a rubber core, a cast urethane cover, and an intermediate layer formed from a high flex ionomer. One of ordinary skill in the art would understand that other materials could be used to form any of these layers or components of the golf ball.

The core can have a diameter of 1.55 inches (+/−0.02 inches). The core can be formed primarily from a mixture of polybutadiene rubber and styrene butadiene rubber. The rubber composition can be crosslinked with a peroxide with the addition of zinc diacrylate as a coagent. Fillers and additives such as pigments, zinc oxide, and barium sulfate, zinc pentachlorothiophenol can also added to adjust gravity and effect final cured core properties, as one of ordinary skill in the art would understand. The core can be formed from various types or blends of rubbers and additives, and the size of the core can vary.

The cover can be formed from a hot cast polyurethane comprising the reaction product of an isocyanate functional prepolymer and an amine functional chain extender, as one of ordinary skill in the art would understand. Additionally, one of ordinary skill in the art would understand that the cover can be formed from other materials or can be formed from other formation techniques.

The intermediate layer can be formed from a 50/50 blend of high acid sodium ionomer and high acid zinc ionomer. One of ordinary skill in the art would understand that this ratio can vary, and the type of ionomers can vary. In other aspects, compositions that do not include ionomers can be used to form the intermediate layer.

The protrusions on the intermediate layer can have a circular base plan shape. The top surface of the protrusions can be spherical and concentric with the radially outer surface of the base portion, and the sidewall surface can have a straight, conical profile. There can be 250 protrusions extending radially as part of the intermediate layer. The protrusions can be arranged in an icosahedral pattern. The dimple pattern on the surface of the golf ball can have 348 dimples. In a more general configuration, there can be 225-275 protrusions, and there can be 325-375 dimples. One of ordinary skill in the art would understand that the quantity of dimples and protrusions can greatly vary.

Table 2 is provided below to further detail specific characteristics of Example 2.

TABLE 2

| | |
|---|---|
| Number of Protrusions | 250 |
| $R_b$ | 0.805 in. |
| $R_{max}$ | 0.825 in. |
| $R_i$ | 0.775 in. |
| $t_b$ | 0.030 in. |
| $V_b$ | 0.235 in.$^3$ |
| $V_p$ | 0.095 in.$^3$ |
| $V_L$ | 0.330 in.$^3$ |
| $R_\mu$ | 0.816 in. |
| $h_p$ | 0.020 in. |
| $S_r$ | 0.35 |

Figure 7A:
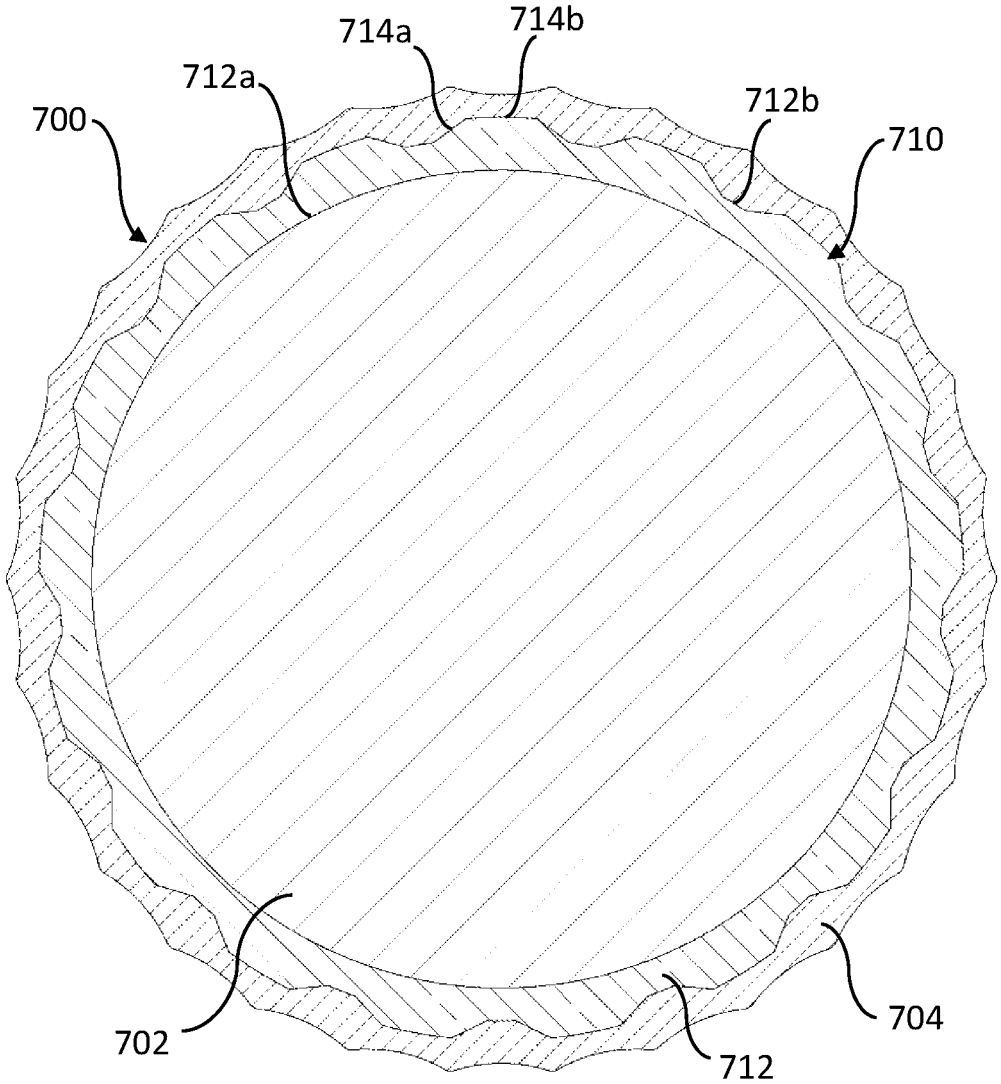
FIG. 7A is a cross-sectional view of a golf ball according to one example.
Figure 7B:
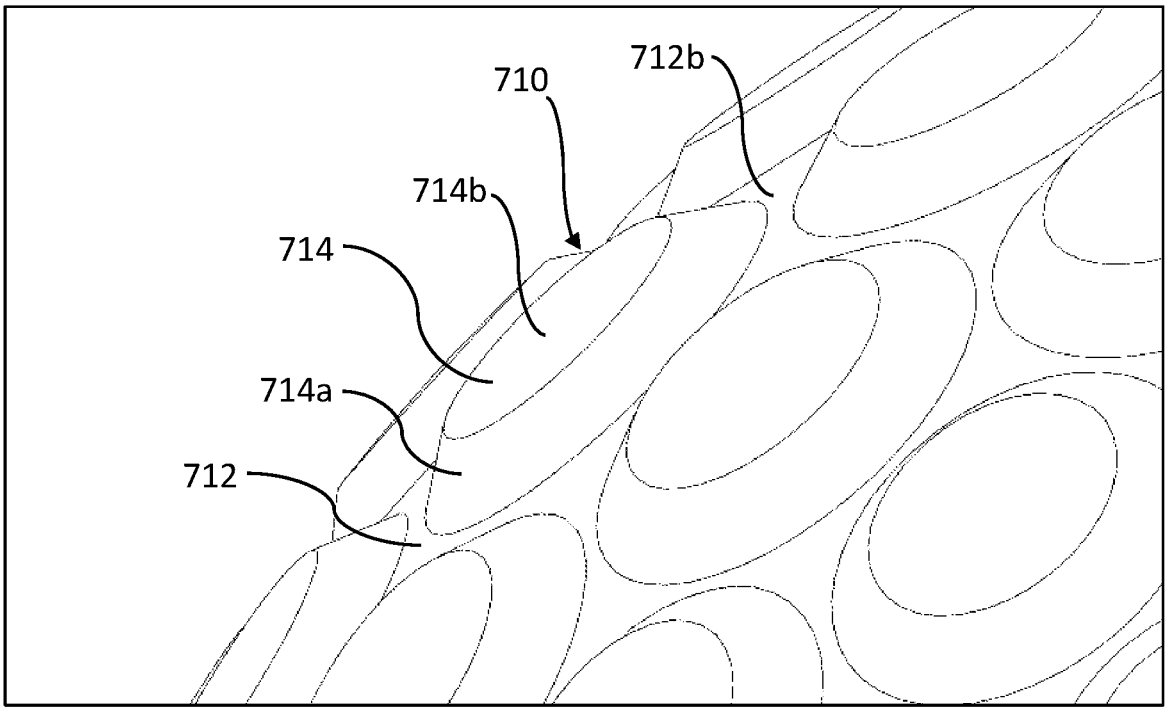
FIG. 7B is a magnified view of a portion of the intermediate layer of the golf ball of FIG. 7A.
Figure 7C:
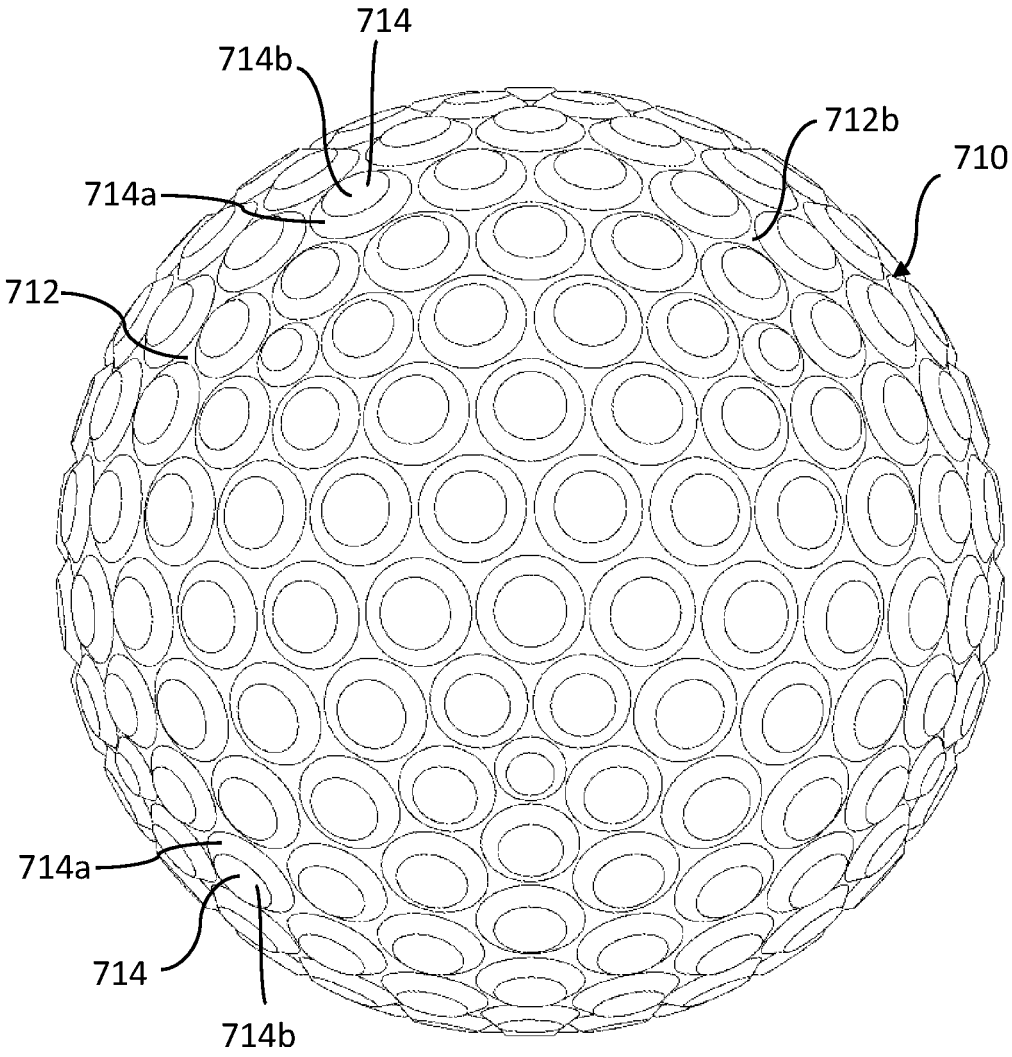
FIG. 7C is a perspective view of the intermediate layer of FIGS. 7A and 7B.

FIGS. 7A-7C illustrate the features for Example 2. FIG. 7A illustrates a golf ball 700 including an intermediate layer 710 with features as disclosed herein. The golf ball 700 further includes a core 702 and a cover 704. The intermediate layer 710 comprises protrusions 714 that extend from a base portion 712. As shown in FIG. 7A, spaces between the protrusions 714 are entirely filled with the cover 704. The base portion 712 can define a radially inner surface 712*a* and a radially outer surface 712*b*. The protrusions 714 can each comprise a sidewall surface 714*a*, and a top surface 714*b* having a spherical profile with a radius of curvature that is concentric with the radially outer surface 712*b* of the base portion 712. The features of the intermediate layer 710 are illustrated in further detail in FIGS. 7B and 7C.

While it is apparent that the illustrative embodiments of the invention disclosed herein fulfill the objectives stated above, it is appreciated that numerous modifications and other embodiments may be devised by those skilled in the art. Therefore, it will be understood that the appended claims are intended to cover all such modifications and embodiments, which would come within the spirit and scope of the present invention.

What is claimed is:

1. A golf ball comprising:

a core;

an intermediate layer disposed around the core and formed from an ionomer, the intermediate layer comprising:

a base portion defining a radially inner surface and a radially outer surface; and a plurality of protrusions extending from the radially outer surface of the base portion, the plurality of protrusions each comprising:

a sidewall surface; and a top surface having a spherical profile with a radius of curvature that is concentric with the radially outer surface of the base portion; and a cover disposed around the intermediate layer, wherein a maximum protrusion height ($h_p$) is defined by:

$$h_p = R_{max} - R_b$$

where ($R_b$) is a base outer surface radius defined by the radially outer surface of the base portion, and ($R_{max}$) is a maximum protrusion radius defined by an outermost radial distance of at least one outermost radial point among the plurality of the protrusions, and the maximum protrusion height ($h_p$) is at least 0.003 inches and no greater than 0.020 inches, wherein the intermediate layer has a contact surface coverage ratio ($S_r$) defined by:

$$S_r = \frac{S_p}{4\pi R_{max}^2}$$

where ($S_p$) is a surface area of all top surfaces of the plurality of protrusions, and wherein the contact surface coverage ratio ($S_r$) is at least 0.15 and no greater than 0.50.

2. The golf ball according to claim 1, wherein the maximum protrusion radius ($R_{max}$) is at least 0.805 inches and no greater than 0.835 inches.

3. The golf ball according to claim 2, wherein the maximum protrusion radius ($R_{max}$) is at least 0.815 inches and no greater than 0.835 inches.

4. The golf ball according to claim 1, wherein the intermediate layer has a base volume ($V_b$) defined by:

$$V_b = \frac{4}{3}\pi\left(R_b^3 - R_i^3\right)$$

where ($R_i$) is a base inner surface radius defined by the radially inner surface of the base portion, wherein the intermediate layer has a volume ($V_L$) defined by:

$$V_L = V_b + V_p$$

where ($V_p$) is a volume of the plurality of protrusions, and wherein a ratio of the volume of the protrusions ($V_p$) to the volume of the base portion ($V_b$) is 0.15-0.45.

5. The golf ball according to claim 1, wherein the intermediate layer has a mean radius ($R_\mu$) defined by:

$$R_\mu = \sqrt[3]{\frac{3V_L}{4\pi} + R_i^3}$$

where ($R_i$) is a base inner surface radius defined by the radially inner surface of the base portion, and wherein the mean radius ($R_\mu$) of the intermediate layer is at least 0.800 inches and no greater than 0.835 inches.

6. The golf ball according to claim 5, wherein the mean radius (Ru) of the intermediate layer is at least 0.810 inches and no greater than 0.825 inches.

7. The golf ball according to claim 1, wherein a quantity of the plurality of protrusions is at least 20 and no greater than 500.

8. The golf ball according to claim 7, wherein a quantity of the plurality of protrusions is at least 200 and no greater than 300.

9. The golf ball according to claim 1, wherein the cover defines a plurality of dimples, and a quantity of the plurality of dimples is greater than a quantity of the plurality of protrusions.

10. The golf ball according to claim 1, wherein the cover defines a plurality of dimples, and a quantity of the plurality of dimples is less than a quantity of the plurality of protrusions.

11. The golf ball according to claim 1, wherein the cover defines a plurality of dimples, and a difference is defined between a quantity of the plurality of dimples and a quantity of the plurality of protrusions.

12. The golf ball according to claim 11, wherein the difference between the quantity of the plurality of dimples and the quantity of the plurality of protrusions is less than 100.

13. The golf ball according to claim 11, wherein the difference between the quantity of the plurality of dimples and the quantity of the plurality of protrusions is at least 100 and no greater than 200.

14. The golf ball according to claim 11, wherein the difference between the quantity of the plurality of dimples and the quantity of the plurality of protrusions is greater than 200.

15. The golf ball according to claim 11, wherein the quantity of the plurality of dimples is 100-200 less than the quantity of the plurality of protrusions.

16. The golf ball according to claim 11, wherein the quantity of the plurality of dimples is 100-200 greater than the quantity of the plurality of protrusions.

17. The golf ball according to claim 1, wherein the base portion has a thickness ($t_b$), and a ratio of the maximum protrusion height ($h_p$) to the thickness ($t_b$) of the base portion is defined by:

$$0.50 \leq \frac{h_p}{t_b} \leq 0.75.$$

18. The golf ball according to claim 1, wherein the plurality of protrusions each have a circular plan profile.

19. The golf ball according to claim 1, wherein the sidewall surface of the plurality of protrusions has a profile that is at least one of: (i) normal relative to the radially outer surface of the base portion, (ii) angled relative to the radially outer surface of the base portion, (iii) curved, (iv) concave, or (v) convex.

* * * * *